US011832356B2

(12) United States Patent
Reynolds et al.

(10) Patent No.: US 11,832,356 B2
(45) Date of Patent: Nov. 28, 2023

(54) RESISTIVE HEATER WITH TEMPERATURE SENSING POWER PINS

(71) Applicant: Watlow Electric Manufacturing Company, St. Louis, MO (US)

(72) Inventors: Jack Reynolds, Maryland Heights, MO (US); Louis P. Steinhauser, St. Louis, MO (US); Jake Spooler, Hannibal, MO (US); William Bohlinger, Winona, MN (US)

(73) Assignee: WATLOW ELECTRIC MANUFACTURING COMPANY, St. Louis, MO (US)

( * ) Notice: Subject to any disclaimer, the term of this patent is extended or adjusted under 35 U.S.C. 154(b) by 164 days.

(21) Appl. No.: 17/073,204

(22) Filed: Oct. 16, 2020

(65) Prior Publication Data

US 2021/0037608 A1 Feb. 4, 2021

Related U.S. Application Data

(62) Division of application No. 15/907,665, filed on Feb. 28, 2018, now Pat. No. 10,880,953, which is a (Continued)

(51) Int. Cl.
*H05B 1/02* (2006.01)
*H05B 3/00* (2006.01)
(Continued)

(52) U.S. Cl.
CPC ..... *H05B 1/0202* (2013.01); *H05B 1/0261* (2013.01); *H05B 3/0014* (2013.01); (Continued)

(58) Field of Classification Search
CPC ..... H05B 2203/003; H05B 3/58; H05B 2203/013; H05B 3/46; H05B 3/82; (Continued)

(56) References Cited

U.S. PATENT DOCUMENTS 1,833,112 A * 11/1931 Harrison ..... G01F 23/247 136/224
2,831,951 A 4/1958 Desloge
(Continued)

FOREIGN PATENT DOCUMENTS

EP 2987579 2/2016
JP 2002243555 8/2002
(Continued)

OTHER PUBLICATIONS

Office Action issued in corresponding Korean Application No. 10-2017-7037552 and English Translation, dated May 19, 2022, 15 pages.

*Primary Examiner* — Chris Q Liu
(74) *Attorney, Agent, or Firm* — Burris Law, PLLC

(57) ABSTRACT

A heater for use in fluid immersion heating includes a plurality of resistive heating elements, and a plurality sets of power pins electrically connected to the plurality of heating elements. Each set of power pins includes a first power pin made of a first conductive material, and a second power pin made of a second conductive material that is dissimilar from the first conductive material of the first power pin. The first power pin is electrically connected to the second power pin to form a junction. The second power pin is electrically connected to the corresponding resistive heating element. The junctions between the first power pins and the second power pins are disposed at different heights in order to sense a level of the fluid.

17 Claims, 14 Drawing Sheets

Related U.S. Application Data division of application No. 14/725,537, filed on May 29, 2015, now Pat. No. 10,728,956.

(51) Int. Cl.

| | |
|---|---|
| ***H05B 3/06*** | (2006.01) |
| ***H05B 3/18*** | (2006.01) |
| ***H05B 3/48*** | (2006.01) |
| ***H05B 3/54*** | (2006.01) |

(52) U.S. Cl.

CPC ..... *H05B 3/06* (2013.01); *H05B 3/18* (2013.01); *H05B 3/48* (2013.01); *H05B 3/54* (2013.01); *H05B 2203/014* (2013.01)

(58) Field of Classification Search

CPC ..... H05B 2203/01; H05B 2203/02; H05B 2203/014; H05B 2203/017; H05B 3/78; H05B 1/02; H05B 1/0291; H05B 2203/004; H05B 2203/033; H05B 3/146; H05B 3/16; H05B 3/18; H05B 3/342; H05B 3/42; H05B 3/48; H05B 6/40

USPC ..... 219/535, 528, 549, 544, 530, 541, 204, 219/211, 212, 522, 531, 540, 543, 553, 219/635, 643, 645, 662, 672; 392/480, 392/468, 465, 472, 485, 494, 503; 73/295

See application file for complete search history.

(56) References Cited

U.S. PATENT DOCUMENTS

| | | | | |
|---|---|---|---|---|
| 3,118,136 | A * | 1/1964 | Steele, III | G01F 23/247 340/622 |
| 3,360,990 | A * | 1/1968 | Greene | G01F 23/246 73/295 |
| 5,714,738 | A * | 2/1998 | Hauschulz | H05B 3/58 219/535 |
| 6,034,360 | A | 3/2000 | Karlsson | |
| 6,072,165 | A | 6/2000 | Feldman | |
| 6,087,631 | A | 7/2000 | Miyazaki | |
| 6,684,708 | B2 * | 2/2004 | Weigl | G01L 19/0023 73/715 |
| 2004/0026410 | A1 | 2/2004 | Tsuchiya | |
| 2005/0008354 | A1 * | 1/2005 | Cassidy | F24H 1/142 392/494 |
| 2008/0066531 | A1 * | 3/2008 | Kawanishi | F02D 41/0025 73/61.76 |
| 2008/0107151 | A1 * | 5/2008 | Khadkikar | G01F 23/22 374/141 |
| 2009/0056437 | A1 * | 3/2009 | Kawanishi | G01F 23/14 73/295 |
| 2013/0192352 | A1 * | 8/2013 | Lanzani | G01F 23/00 73/61.76 |

FOREIGN PATENT DOCUMENTS

| | | |
|---|---|---|
| KR | 1019990028880 A | 4/1999 |
| TW | 201506368 | 2/2015 |
| TW | 201705812 | 2/2017 |

* cited by examiner

RESISTIVE HEATER WITH TEMPERATURE SENSING POWER PINS

CROSS-REFERENCE TO RELATED APPLICATIONS

The present application is a divisional application of U.S. Ser. No. 15/907,665, filed Feb. 28, 2018, which is a divisional application of U.S. Ser. No. 14/725,537, filed on May 29, 2015, now U.S. Pat. No. 10,728,956. The entire disclosures of both applications are incorporated herein by reference.

FIELD

The present disclosure relates to resistive heaters and to temperature sensing devices such as thermocouples.

BACKGROUND

The statements in this section merely provide background information related to the present disclosure and may not constitute prior art.

Resistive heaters are used in a variety of applications to provide heat to a target and/or environment. One type of resistive heater known in the art is a cartridge heater, which generally consists of a resistive wire heating element wound around a ceramic core. A typical ceramic core defines two longitudinal bores with power/terminal pins disposed therein. A first end of the resistive wire is electrically connected to one power pin and the other end of the resistive wire electrically connected to the other power pin. This assembly is then inserted into a tubular metal sheath of a larger diameter having an open end and a closed end, or two open ends, thus creating an annular space between the sheath and the resistive wire/core assembly. An insulative material, such as magnesium oxide (MgO) or the like, is poured into the open end of the sheath to fill the annular space between the resistive wire and the inner surface of the sheath.

The open end of the sheath is sealed, for example by using a potting compound and/or discrete sealing members. The entire assembly is then compacted or compressed, as by swaging or by other suitable process, to reduce the diameter of the sheath and to thus compact and compress the MgO and to at least partially crush the ceramic core so as to collapse the core about the pins to ensure good electrical contact and thermal transfer. The compacted MgO provides a relatively good heat transfer path between the heating element and the sheath and it also electrically insulates the sheath from the heating element.

In order to determine the proper temperature at which the heaters should be operating, discrete temperature sensors, for example thermocouples, are placed on or near the heater. Adding discrete temperature sensors to the heater and its environment can be costly and add complexity to the overall heating system.

SUMMARY

In one form, a heater for use in fluid immersion heating is provided, which includes a plurality of resistive heating elements, and a plurality sets of power pins electrically connected to the plurality of heating element. Each set of power pins includes a first power pin made of a first conductive material, and a second power pin made of a second conductive material that is dissimilar from the first conductive material of the first power pin, the first power pin being electrically connected to the second power pin to form a junction, and the second power pin being electrically connected to the corresponding resistive heating element. The junctions between the first power pins and the second power pins are disposed at different heights in order to sense a level of the fluid.

In another form, a heater for use in fluid immersion heating is provided that includes a heating portion configured for immersion into the fluid, the heating portion comprising a plurality of resistive heating elements. At least two non-heating portions are contiguous with the heating portion, each non-heating portion defining a length and comprising a corresponding plurality of sets of power pins electrically connected to the plurality of heating elements. Each set of power pins comprises a first power pin made of a first conductive material and a second power pin made of a second conductive material that is dissimilar from the first conductive material of the first power pin. The first power pin is electrically connected to the second power pin within the non-heating portion to form a junction, and the second power pin extends into the heating portion is electrically connected to the corresponding resistive heating element. The second power pin defines a cross-sectional area that is larger than the corresponding resistive heating element. At least two termination portions are contiguous with the non-heating portions, wherein the plurality of first power pins exit the non-heating portions and extend into the termination portions for electrical connection to lead wires and a controller. In one form, each of the resistive heating elements are made of a material that is different from the first and second conductive materials of the first and second power pins, and each of the junctions of the first power pin to the second power pin is disposed at a different location along the lengths of the non-heating portions in order to sense a level of the fluid.

In still another form, a heater for use in fluid immersion heating is provided, which includes a plurality of resistive heating elements, and a plurality of power pins connected to the plurality of resistive heating elements for supplying power to the plurality of resistive heating elements. The plurality of power pins each include a first material portion and a second material portion to form a thermocouple junction therebetween. The thermocouple junctions of the plurality of power pins are disposed at different height from the resistive heating elements.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
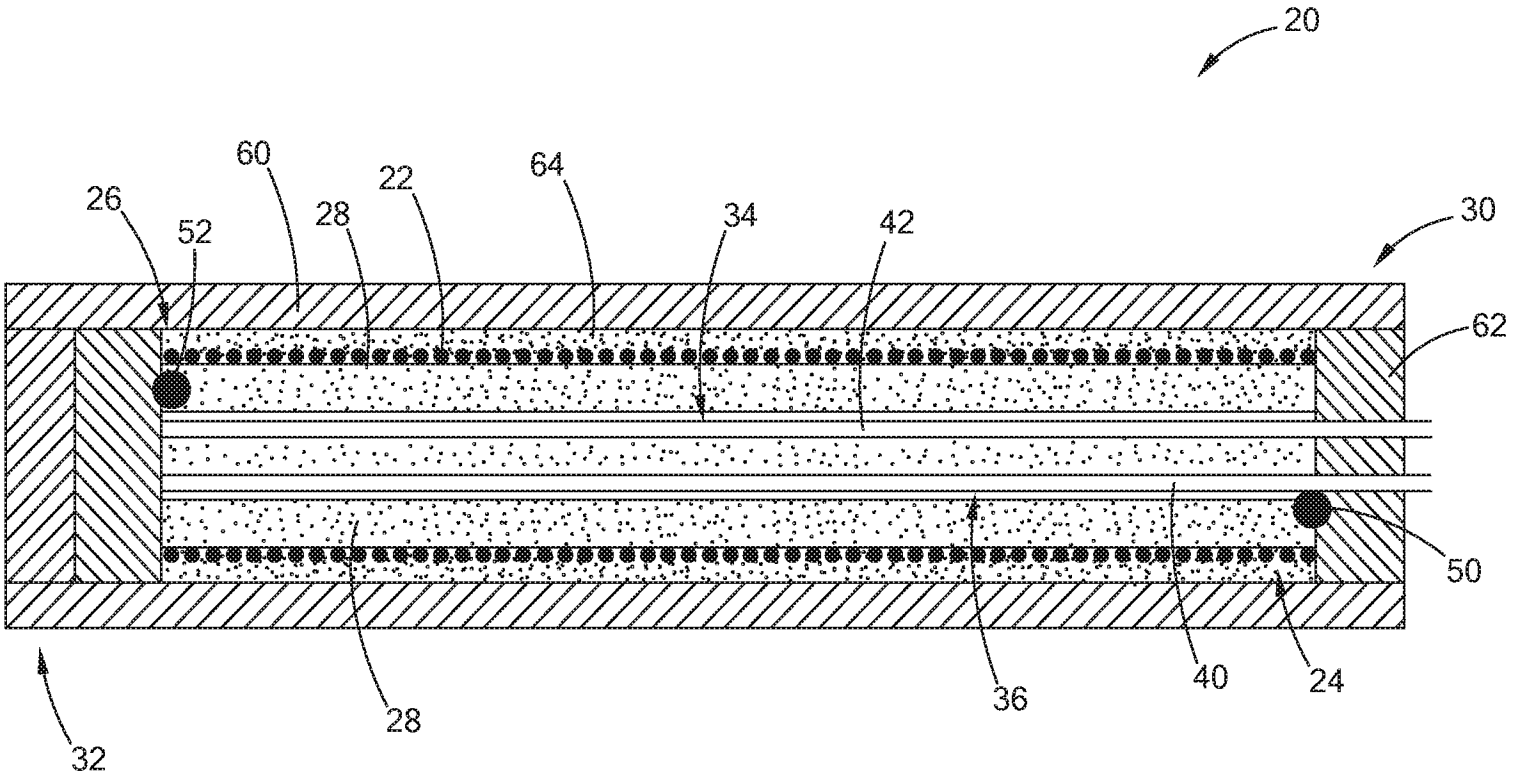
FIG. 1 is a side cross-sectional view of a resistive heater with dual purpose power pins constructed in accordance with the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIG. 1, a heater according to the teachings of the present disclosure is illustrated and generally indicated by reference numeral 20. The heater 20 in this form is a cartridge heater, however, it should be understood that the teachings of the present disclosure may be applied to other types of heaters as set forth in greater detail below while remaining within the scope of the present disclosure. As shown, the heater 20 comprises a resistive heating element 22 having two end portions 24 and 26, and the resistive heating element 22 is in the form of a metal wire, such as a nichrome material by way of example. The resistive heating element 22 is wound or disposed around a non-conductive portion (or core in this form) 28. The core 28 defines a proximal end 30 and a distal end 32 and further defines first and second apertures 34 and 36 extending through at least the proximal end 30.

The heater 20 further comprises a first power pin 40 that is made of a first conductive material and a second power pin 42 that is made of a second conductive material that is dissimilar from the first conductive material of the first power pin 40. Further, the resistive heating element 22 is made of a material that is different from the first and second conductive materials of the first and second power pins 40, 42 and forms a first junction 50 at end 24 with the first power pin 40 and a second junction 52 at its other end 26 with the second power pin 42. Because the resistive heating element 22 is a different material than the first power pin 40 at junction 50 and is a different material than the second power pin 42 at junction 52, a thermocouple junction is effectively formed and thus changes in voltage at the first and second junctions 50, 52 are detected (as set forth in greater detail below) to determine an average temperature of the heater 20 without the use of a separate/discrete temperature sensor.

In one form, the resistive heating element 22 is a nichrome material, the first power pin 40 is a Chromel® nickel alloy, and the second power pin 42 is an Alumel® nickel alloy. Alternately, the first power pin 40 could be iron, and the second power pin 42 could be constantan. It should be appreciated by those skilled in the art that any number of different materials and their combinations can be used for the resistive heating element 22, the first power pin 40, and the second power pin 42, as long as the three materials are different and a thermocouple junction is effectively formed at junctions 50 and 52. The materials described herein are merely exemplary and thus should not be construed as limiting the scope of the present disclosure.

In one application, the average temperature of the heater 20 may be used to detect the presence of moisture. If moisture is detected, moisture management control algorithms can then be implemented via a controller (described in greater detail below) in order to remove the moisture in a controlled manner rather than continuing to operate the heater 20 and a possible premature failure.

As further shown, the heater 20 includes a sheath 60 surrounding the non-conductive portion 28 and a sealing member 62 disposed at the proximal end 30 of the non-conductive portion 28 and extending at least partially into the sheath 60 to complete the heater assembly. Additionally, a dielectric fill material 64 is disposed between the resistive heating element 22 and the sheath 60. Various constructions and further structural and electrical details of cartridge heaters are set forth in greater detail in U.S. Pat. Nos. 2,831,951 and 3,970,822, which are commonly assigned with the present application and the contents of which are incorporated herein by reference in their entirety. Therefore, it should be understood that the form illustrated herein is merely exemplary and should not be construed as limiting the scope of the present disclosure.

Figure 2:
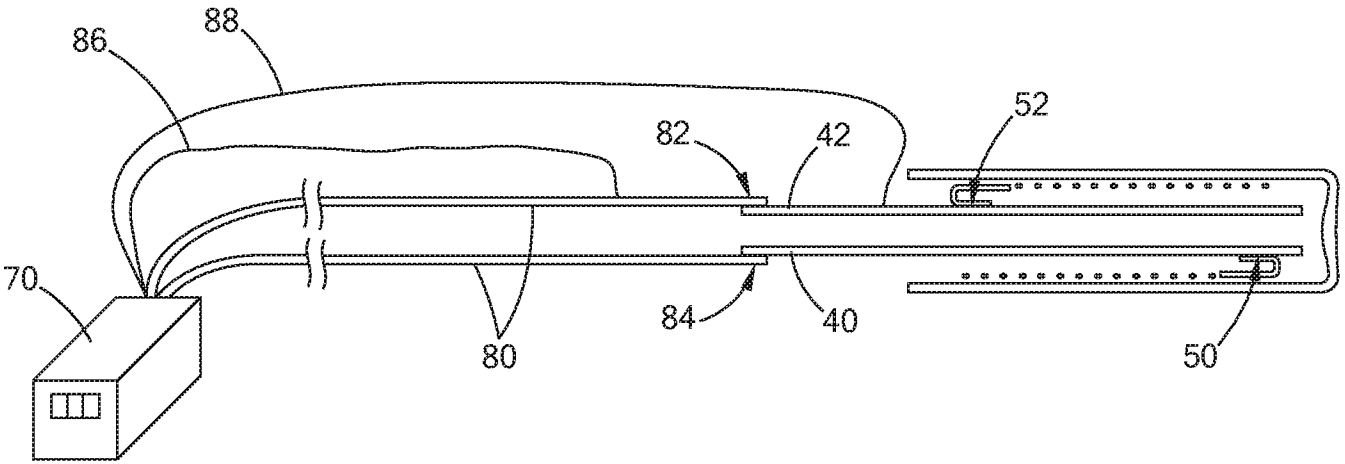
FIG. 2 is a perspective view of the resistive heater of FIG. 1 and a controller with lead wires constructed in accordance with the teachings of the present disclosure.

Referring now to FIG. 2, the present disclosure further includes a controller 70 in communication with the first and second power pins 40, 42 and configured to measure changes in voltage at the first and second junctions 50, 52. More specifically, the controller 70 measures millivolt (mV) changes at the junctions 50, 52 and then uses these changes in voltage to calculate an average temperature of the heater 20. In one form, the controller 70 measures changes in voltage at the junctions 50, 52 without interrupting power to the resistive heating element 22. This may be accomplished, for example, by taking a reading at the zero crossing of an AC input power signal. In another form, power is interrupted and the controller 70 switches from a heating mode to a measuring mode to measure the changes in voltage. Once the average temperature is determined, the controller 70 switches back to the heating mode, which is described in greater detail below. More specifically, in one form, a triac is used to switch AC power to the heater 20, and temperature information is gathered at or near the zero-cross of the power signal. Other forms of AC switching devices may be employed while remaining within the scope of the present disclosure, and thus the use of a triac is merely exemplary and should not be construed as limiting the scope of the present disclosure.

Figure 3:
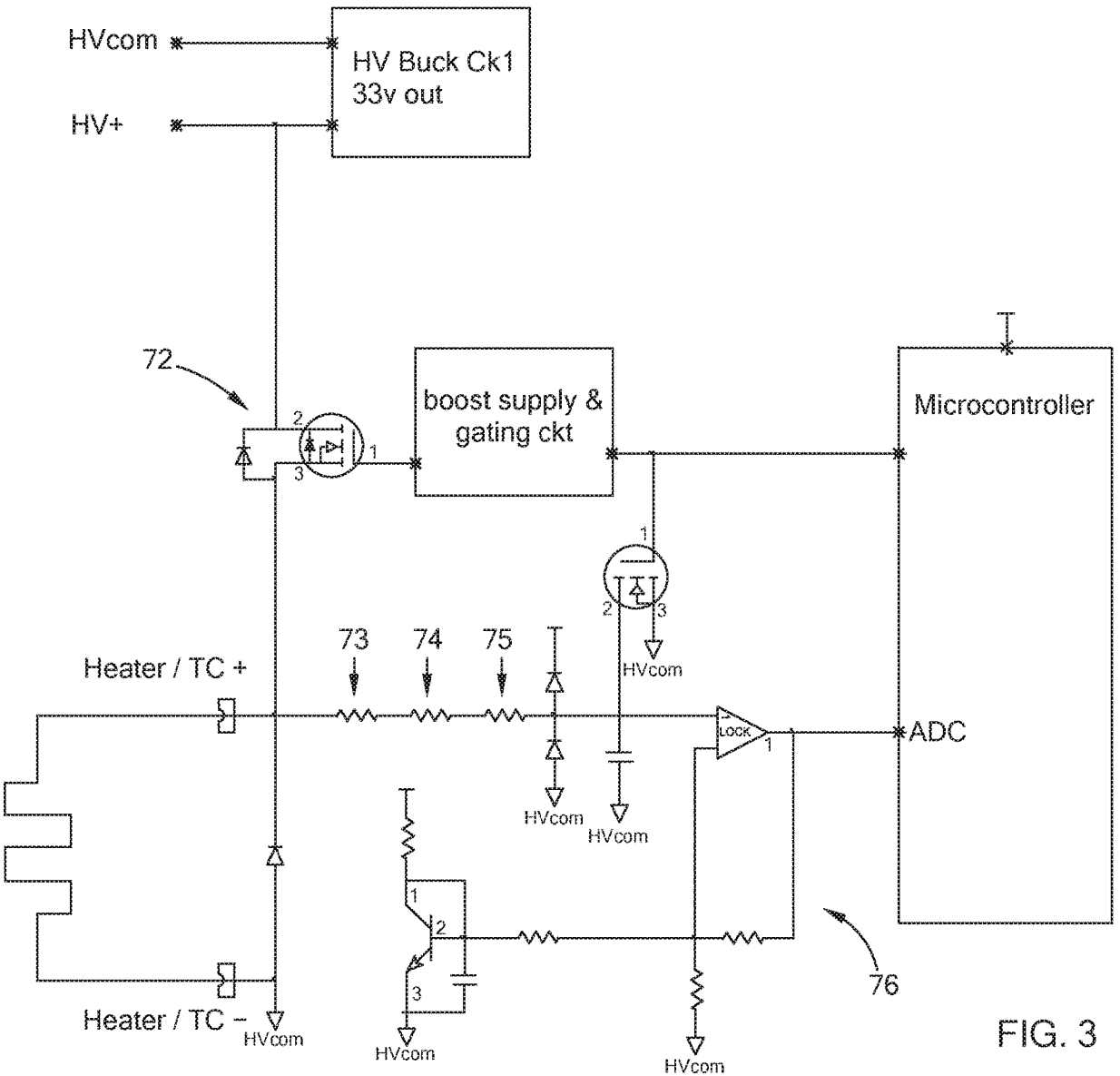
FIG. 3 is a circuit diagram illustrating a switching circuit and measurement circuit constructed in accordance with one form of the present disclosure.

Alternately, as shown in FIG. 3, a FET 72 is used as a switching device and means of measuring voltage during an off-period of the FET with a DC power supply. In one form, three (3) relatively large resistors 73, 74, and 75 are used to form a protective circuit for the measurement circuit 76. It should be understood that this switching and measurement circuit is merely exemplary and should not be construed as limiting the scope of the present disclosure.

Referring back to FIG. 2, a pair of lead wires 80 are connected to the first power pin 40 and the second power pin 42. In one form, the lead wires 80 are both the same material such as, by way of example, copper. The lead wires 80 are provided to reduce the length of power pins needed to reach the controller 70, while introducing another junction by virtue of the different materials at junctions 82 and 84. In this form, in order for the controller 70 to determine which junction is being measured for changes in voltage, signal wires 86 and 88 may be employed such that the controller 70 switches between the signal wires 86 and 88 to identify the junction being measured. Alternately, the signal wires 86 and 88 may be eliminated and the change in voltage across the lead wire junctions 82 and 84 can be negligible or compensated through software in the controller 70.

Figure 4:
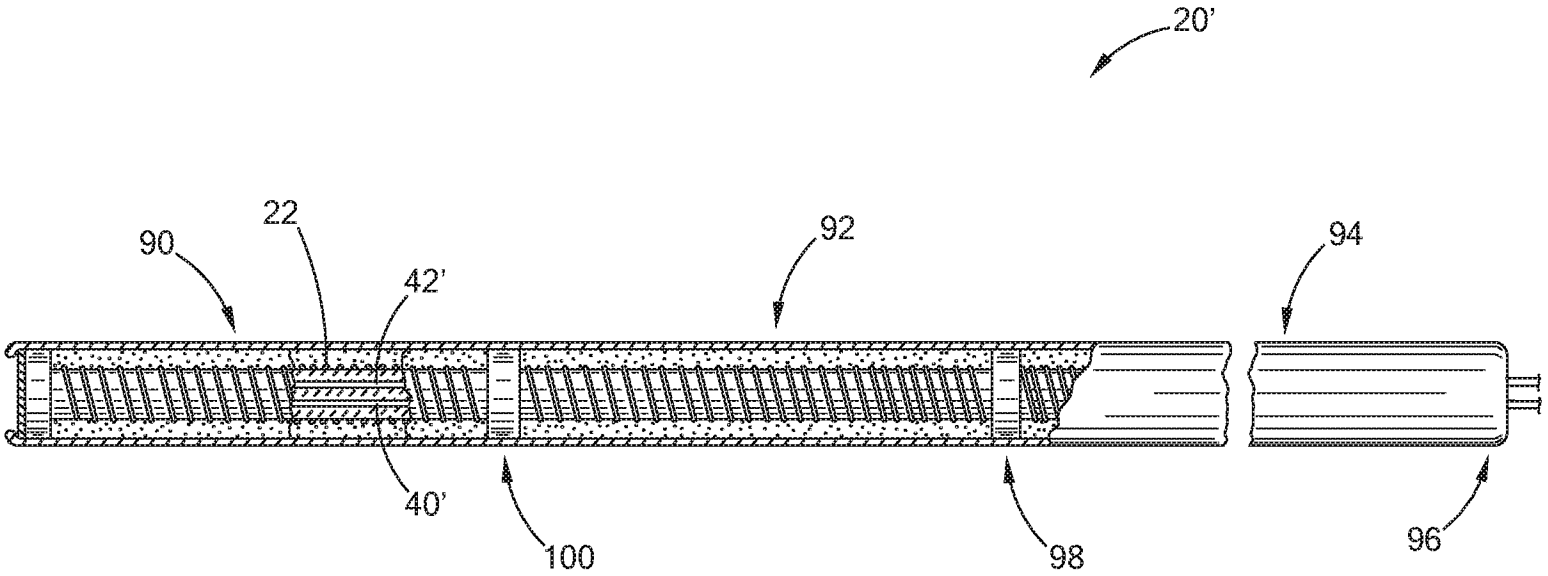
FIG. 4 is a side cross-sectional view of an alternate form of the heater having a plurality of heating zones and constructed in accordance with the teachings of the present disclosure.

Referring now to FIG. 4, the teachings of the present disclosure may also be applied to a heater 20' having a plurality of zones 90, 92 and 94. Each of the zones includes its own set of power pins 40', 42' and resistive heating element 22' as described above (only one zone 90 is illustrated for purposes of clarity). In one form of this multi-zone heater 20', the controller 70 (not shown) would be in communication with the end portions 96, 98, and 100 of each of the zones in order to detect voltage changes and thus determine an average temperature for that specific zone. Alternately, the controller 70 could be in communication with only the end portion 96 to determine the average temperature of the heater 20' and whether or not moisture may be present as set forth above. Although three (3) zones are shown, it should be understood that any number of zones may be employed while remaining within the scope of the present disclosure.

Figure 5:
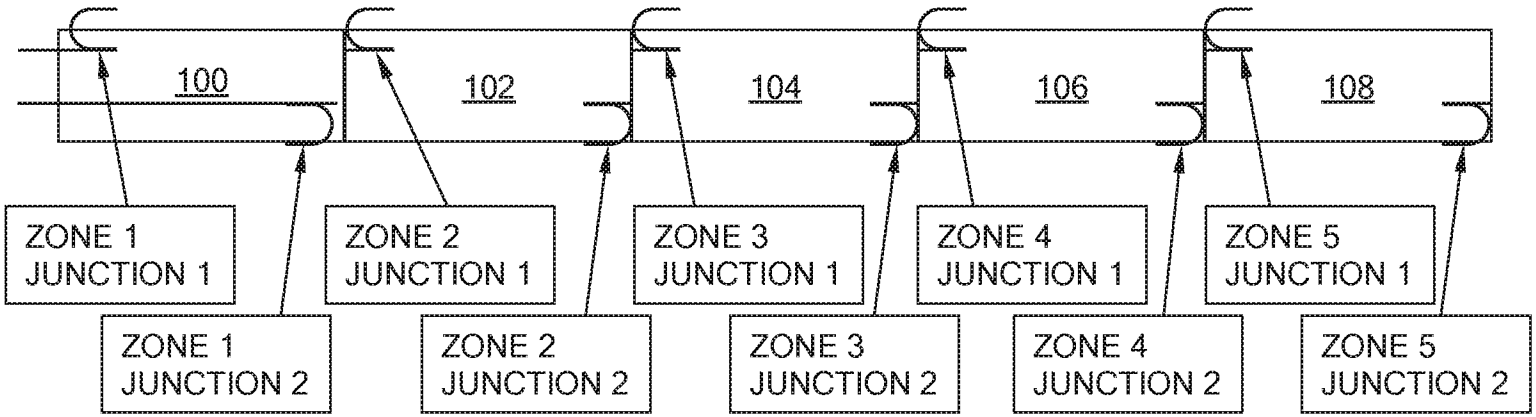
FIG. 5 is a side elevational view of an alternate form of the present disclosure illustrating a plurality of heaters connected in sequence and constructed in accordance with the teachings of the present disclosure.

Turning now to FIG. 5, the teachings of the present disclosure may also be applied to a plurality of separate heaters 100, 102, 104, 106, and 108, which may be cartridge heaters, and which are connected in sequence as shown. Each heater comprises first and second junctions of the dissimilar power pins to the resistive heating element as shown and thus the average temperature of each heater 100, 102, 104, 106, and 108 can be determined by a controller 70 as set forth above. In another form, each of the heaters 100, 102, 104, 106, and 108 has its own power supply pin and a single power return pin is connected to all of the heaters in order to reduce the complexity of this multiple heater embodiment. In this form with cartridge heaters, each core would include passageways to accommodate power supply pins for each successive heater.

Figure 6:
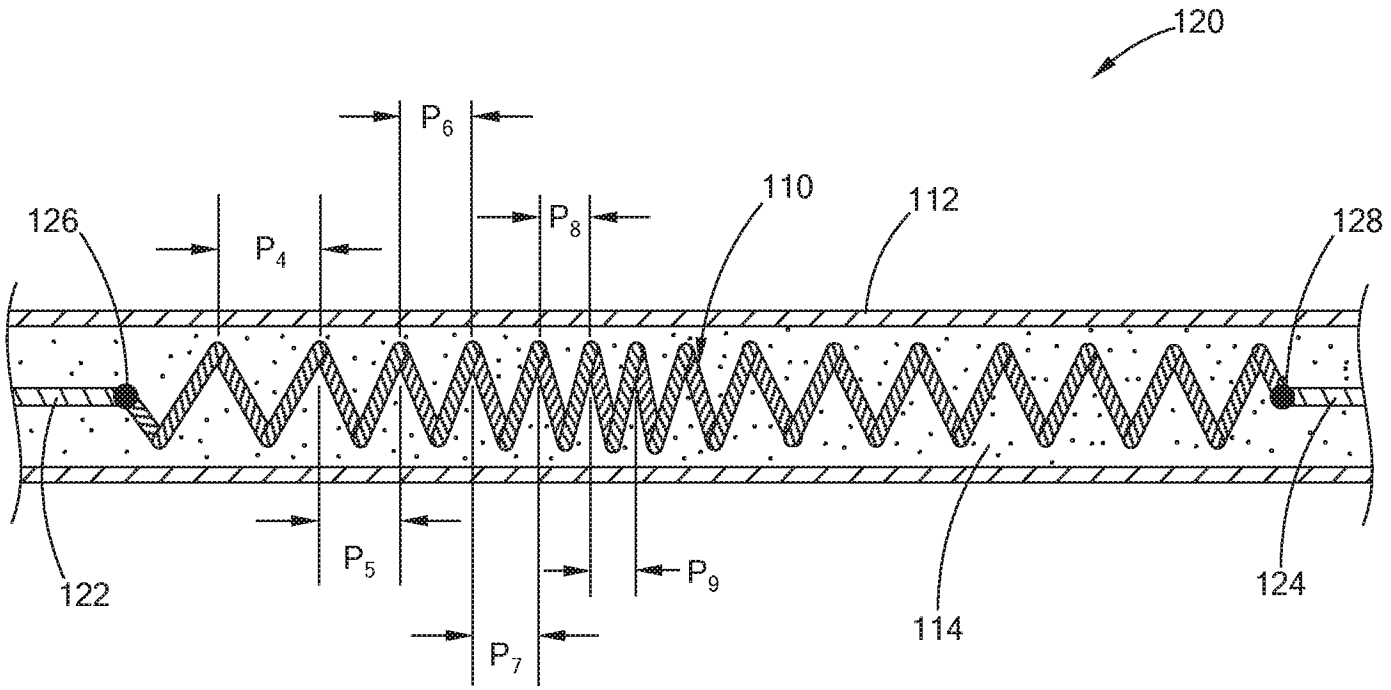
FIG. 6 is a side cross-sectional view of another form of the heater having a resistive element with a continuously variable pitch and constructed in accordance with the teachings of the present disclosure.
Figure 7:
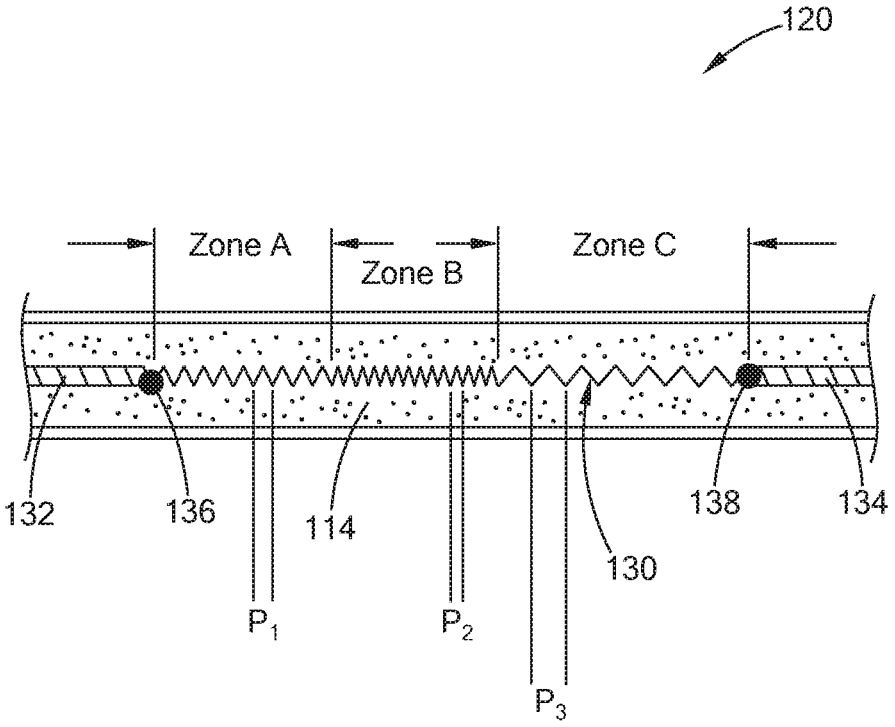
FIG. 7 is a side cross-sectional view of another form of the heater having a resistive element with different pitches in a plurality of heating zones and constructed in accordance with the teachings of the present disclosure.

Referring now to FIGS. 6 and 7, a pitch of the resistive heating element 110 may be varied in accordance with another form of the present disclosure in order to provide a tailored heat profile along the heater 120. In one form (FIG. 5), the resistive heating element 110 defines a continuously variable pitch along its length. More specifically, the resistive heating element 110 has a continuously variable pitch with the ability to accommodate an increasing or decreasing pitch $P_4$-$P_9$ on the immediately adjacent next 360 degree coil loop. The continuously variable pitch of resistive heating element 110 provides gradual changes in the flux density of a heater surface (e.g., the surface of a sheath 112). Although the principle of this continuously variable pitch is shown as applied to a tubular heater having filled insulation 114, the principles may also be applied to any type of heater, including without limitation, the cartridge heater as set forth above. Additionally, as set forth above, the first power pin 122 is made of a first conductive material, the second power pin 124 is made of a second conductive material that is dissimilar from the first conductive material of the first power pin 122, while the resistive heating element 110 is made of a material that is different from the first and second conductive materials of the first and second power pins 122, 124 so that changes in voltage at the first and second junctions 126, 128 are detected to determine an average temperature of the heater 120.

In another form (FIG. 7), the resistive heating element 130 has pitches $P_1$, $P_2$, and $P_3$ in zones A, B, and C, respectively. $P_3$ is greater than $P_1$, and $P_1$ is greater than $P_2$. The resistive heating element 130 has a constant pitch along the length of each zone as shown. Similarly, the first power pin 132 is made of a first conductive material, the second power pin 134 is made of a second conductive material that is dissimilar from the first conductive material of the first power pin 132, while the resistive heating element 130 is made of a material that is different from the first and second conductive materials of the first and second power pins 132, 134 so that changes in voltage at the first and second junctions 136, 138 are detected to determine an average temperature of the heater 120.

Figure 8:
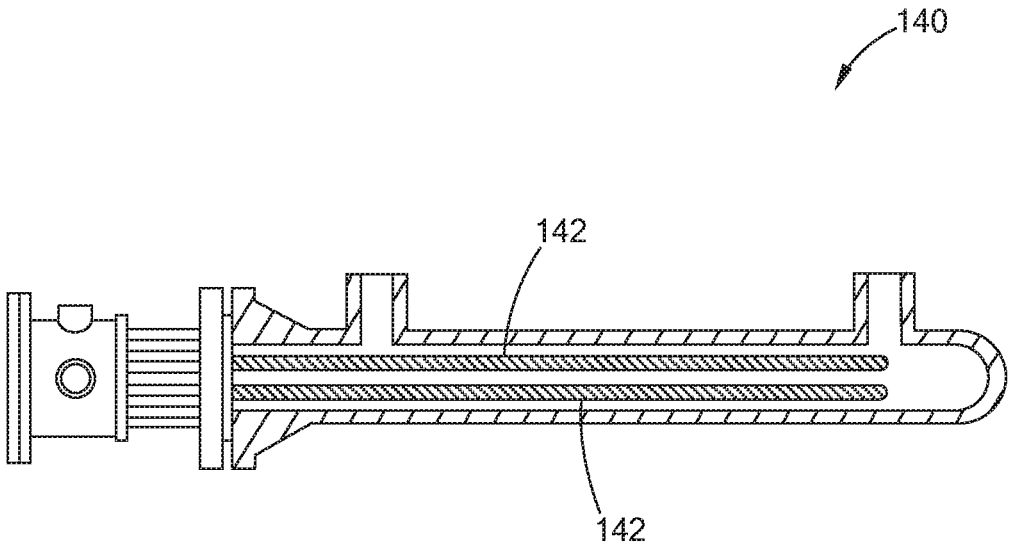
FIG. 8 is a side cross-sectional view of a heat exchanger employing a heater and constructed in accordance with the teachings of the present disclosure.

Referring to FIG. 8, the heater and dual purpose power pins as described herein have numerous applications, including by way of example a heat exchanger 140. The heat exchanger 140 may include one or a plurality of heating elements 142, and each of the heating elements 142 may further include zones or variable pitch resistive heating elements as illustrated and described above while remaining within the scope of the present disclosure. It should be understood that the application of a heat exchanger is merely exemplary and that the teachings of the present disclosure may be employed in any application in which heat is being provided while also requiring a temperature measurement, whether that temperature be absolute or for another environmental condition such as the presence of moisture as set forth above.

Figure 9:
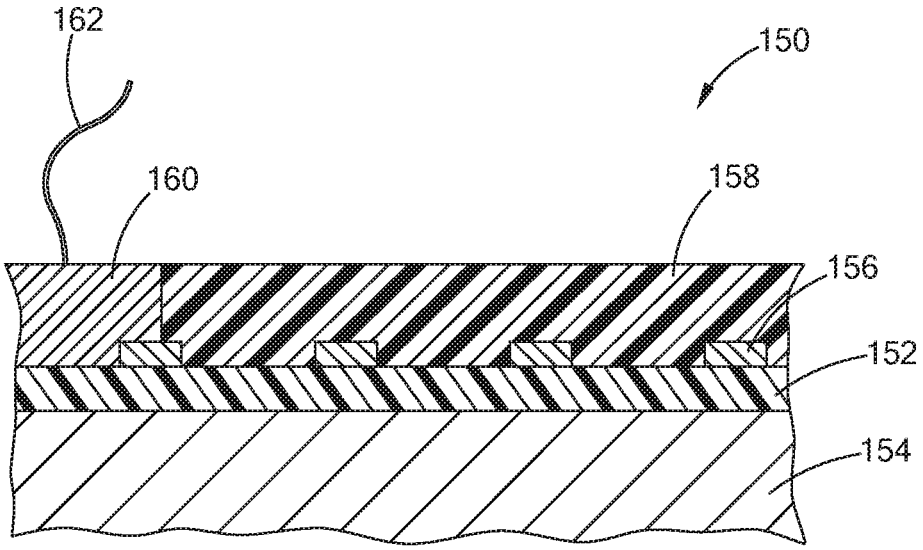
FIG. 9 is a side cross-sectional view illustrating a layered heater employing the dual purpose power pins and constructed in accordance with the teachings of the present disclosure.

As shown in FIG. 9, the teachings of the present disclosure may also be applied to other types of heaters such as a layered heater 150. Generally, the layered heater 150 includes a dielectric layer 152 that is applied to a substrate 154, a resistive heating layer 156 applied to the dielectric layer 152, and a protective layer 158 applied over the resistive heating layer 156. A junction 160 is formed between one end of a trace of the resistive heating layer 156 and a first lead wire 162 (only one end is shown for purposes of clarity), and similarly a second junction is formed at another end, and following the principles of the present disclosure as set forth above, voltage changes at these junctions are detected in order to determine the average temperature of the heater 150. Such layered heaters are illustrated and described in greater detail in U.S. Pat. No.

8,680,443, which is commonly assigned with the present application and the contents of which are incorporated herein by reference in their entirety.

Other types of heaters rather than, or in addition to the cartridge, tubular, and layered heaters as set forth above may also be employed according to the teachings of the present disclosure. These additional types of heaters may include, by way of example, a polymer heater, a flexible heater, heat trace, and a ceramic heater. It should be understood that these types of heaters are merely exemplary and should not be construed as limiting the scope of the present disclosure.

Figure 10:
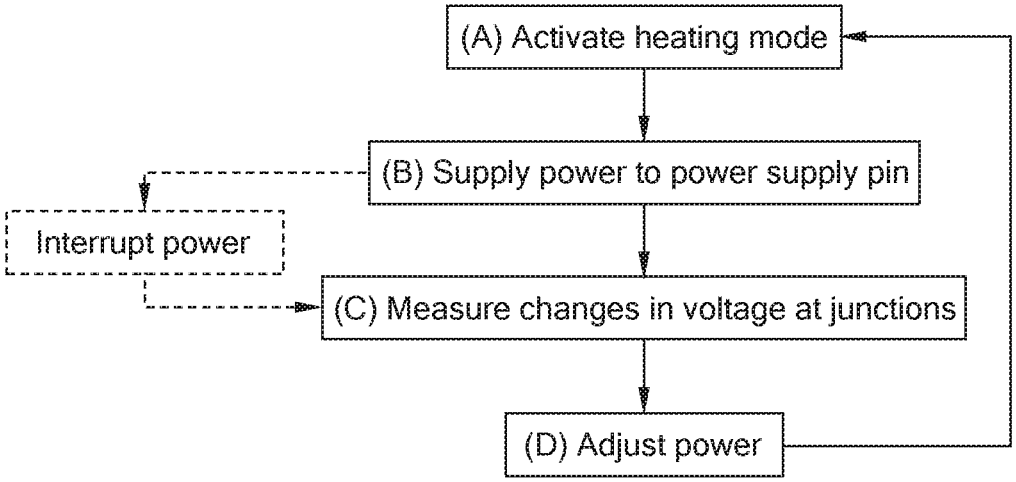
FIG. 10 is a flow diagram illustrating a method in accordance with the teachings of the present disclosure.

Referring now to FIG. 10, a method of controlling at least one heater in accordance with the teachings of the present disclosure is shown. The method comprises the steps of:

(A) activating a heating mode to supply power to a power supply pin, the power supply pin made of a first conductive material, and to return the power through a power return pin, the power return pin made of a conductive material that is dissimilar from the first conductive material;

(B) supplying power to the power supply pin, to a resistive heating element having two ends and made of a material that is different from the first and second conductive materials of the power supply and return pins, the resistive heating element forming a first junction at one end with the power supply pin and a second junction at its other end with the power return pin, and further supplying the power through the power return pin;

(C) measuring changes in voltage at the first and second junctions to determine an average temperature of the heater;

(D) adjusting the power supplied to the heater as needed based on the average temperature determined in step (C); and (E) repeating steps (A) through (D).

In another form of this method, as shown by the dashed lines, step (B) is interrupted while the controller switches to a measuring mode to measure the change in voltage, and then the controller is switched back to the heating mode.

Figure 11:
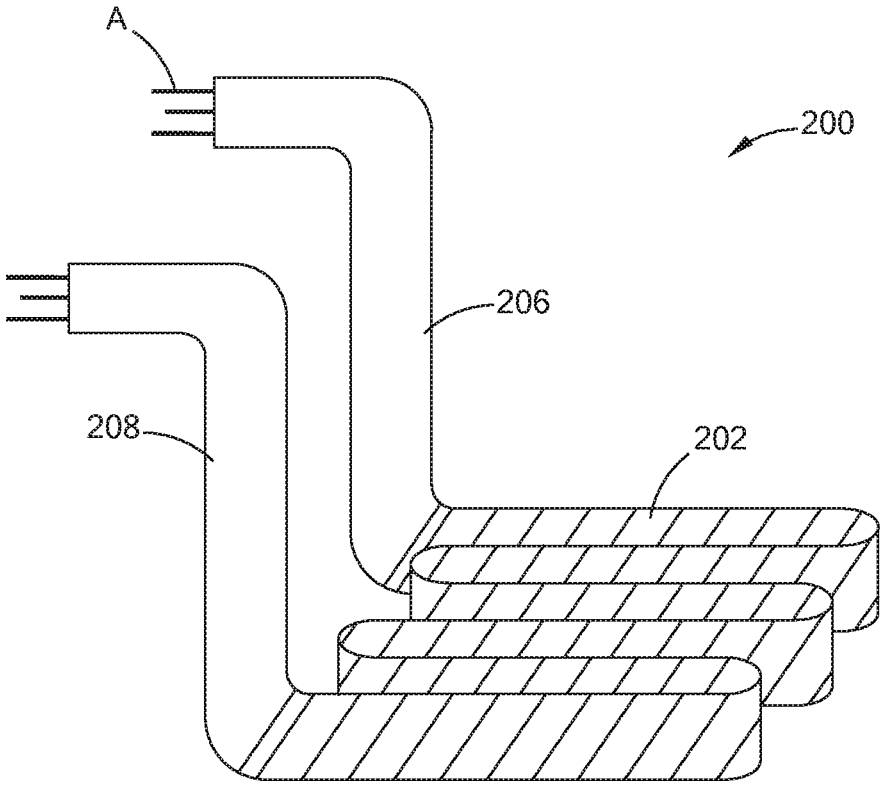
FIG. 11 is a perspective view of a heater for use in fluid immersion heating and constructed in accordance with the teachings of the present disclosure.
Figure 12:
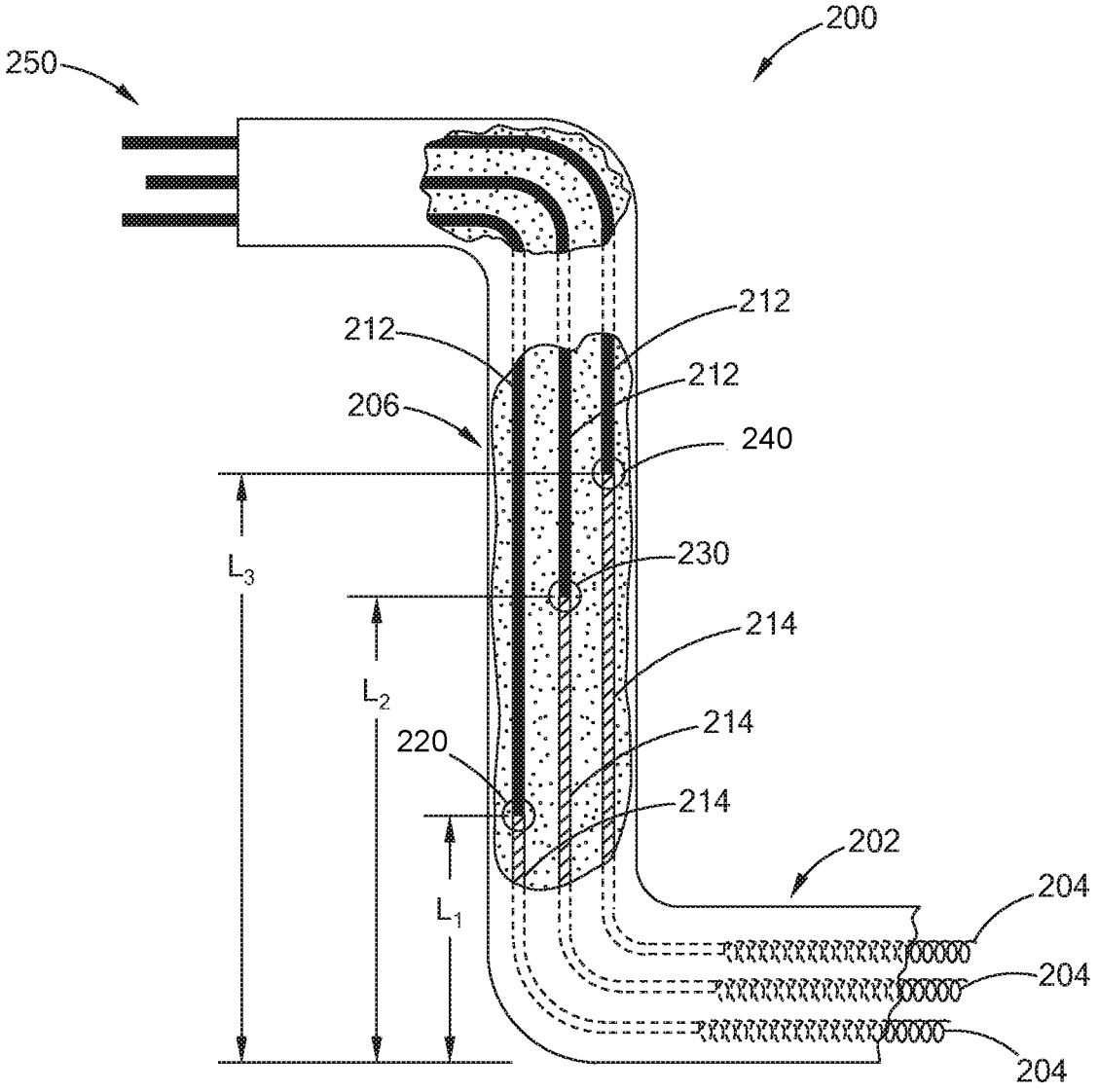
FIG. 12 is a side cross-sectional view of a portion of the heater of FIG. 11 in accordance with the teachings of the present disclosure.
Figure 13:
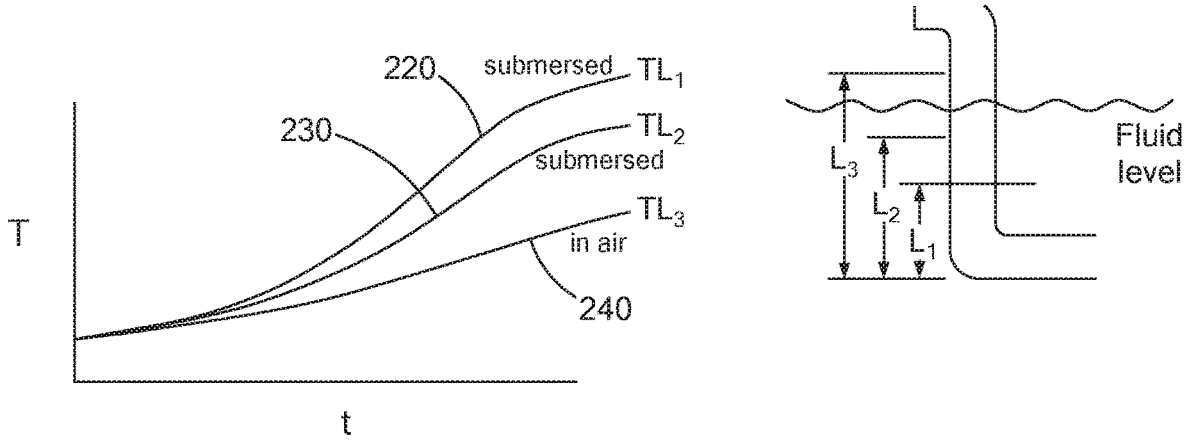
FIG. 13 is a graph illustrating exemplary differences in temperature at the various junctions of the heater of FIG. 10 in accordance with the teachings of the present disclosure.

Yet another form of the present disclosure is shown in FIGS. 11-13, wherein a heater for use in fluid immersion heating is illustrated and generally indicated by reference numeral 200. The heater 200 comprises a heating portion 202 configured for immersion into a fluid, the heating portion 202 comprising a plurality of resistive heating elements 204, and at least two non-heating portions 206, 208 contiguous with the heating portion 202 (only one non-heating portion 206 is shown in FIG. 11). Each non-heating portion 206, 208 defines a length and comprises a corresponding plurality of sets of power pins electrically connected to the plurality of heating elements 204. More specifically, each set of power pins comprises a first power pin 212 made of a first conductive material and a second power pin 214 made of a second conductive material that is dissimilar from the first conductive material of the first power pin 212. The first power pins 212 are electrically connected to the second power pins 214 within the non-heating portions 206, 208 to form junctions 220, 230, and 240. As further shown, the second power pins 214 extend into the heating portion 202 and are electrically connected to the corresponding resistive heating elements 204. Further, the second power pins 214 define a cross-sectional area that is larger than the corresponding resistive heating element 204 so as to not create another junction or measureable amount of heat at the connection between the second power pins 214 and the resistive heating elements 204.

As further shown, a termination portion 250 is contiguous with the non-heating portion 206, and the plurality of first power pins 212 exit the non-heating portion 206 and extend into the termination portions 250 for electrical connection to lead wires and a controller (not shown). Similar to the previous description, each of the resistive heating elements 204 are made of a material that is different from the first and second conductive materials of the first and second power pins 212, 214, and wherein each of the junctions 220, 230, and 240 of the first power pin 212 to the second power pin 214 is disposed at a different location along the lengths of the non-heating portions 206, 208. More specifically, and by way of example, junction 220 is at a distance $L_1$, junction 230 is at a distance $L_2$, and junction 240 is at a distance $L_3$.

As shown in FIG. 13, with temperature of the junctions 220, 230, and 240 over time "t," the junction 220 is submerged in the fluid F, the junction 230 is submerged but not as deep in the fluid, and the junction 240 is not submerged. Accordingly, detecting changes in voltage at each of the junctions 220, 230, and 240 can provide an indication of the fluid level relative to the heating portion 202. It is desirable, especially when the fluid is oil in a cooking/fryer application, that the heating portion 202 not be exposed to air during operation so as to not cause a fire. With the junctions 220, 230, and 240 according to the teachings of the present disclosure, a controller can determine if the fluid level is too close to the heating portion 202 and thus disconnect power from the heater 200.

Although three (3) junctions 220, 230, and 240 are illustrated in this example, it should be understood that any number of junctions may be employed while remaining within the scope of the present disclosure, provided that the junctions are not in the heating portion 202.

Figure 14:
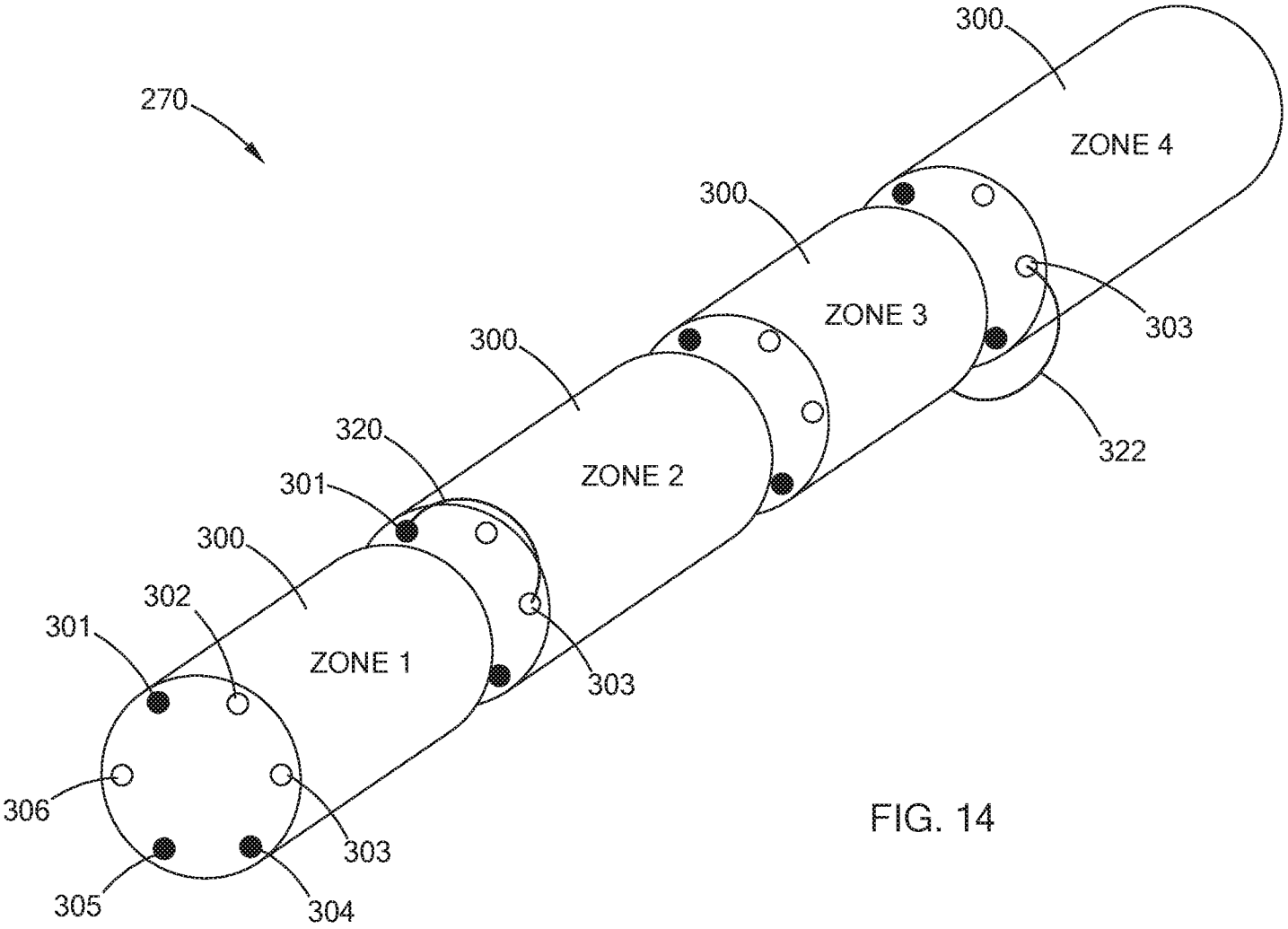
FIG. 14 is a perspective view of another form of the present disclosure having a plurality of heater cores in zones and constructed in accordance with the teachings of the present disclosure.

Referring now to FIG. 14, yet another form of the present disclosure includes a plurality of heater cores 300 arranged in zones of a heater system 270 as shown. The heater cores 300 in this exemplary form are cartridge heaters as described above, however, it should be understood that other types of heaters as set forth herein may also be employed. Accordingly, the cartridge heater construction in this form of the present disclosure should not be construed as limiting the scope of the present disclosure.

Each heater core 300 includes a plurality of power pins 301, 302, 303, 304, and 305 as shown. Similar to the forms described above, the power pins are made of different conductive materials, and more specifically, power pins 301, 304, and 305 are made of a first conductive material, power pins 302, 303, and 306 are made of a second conductive material that is dissimilar from the first conductive material. As further shown, at least one jumper 320 is connected between dissimilar power pins, and in this example, power pin 301 and power pin 303, in order to obtain a temperature reading proximate the location of the jumper 320. The jumper 320 may be, for example, a lead wire or other conductive member sufficient to obtain the millivolt signal indicative of temperature proximate the location of the jumper 320, which is also in communication with the controller 70 as illustrated and described above. Any number of jumpers 320 may be used across dissimilar power pins, and another location is illustrated at jumper 322 between power pin 303 and power pin 305, between ZONE 3 and ZONE 4.

In this exemplary form, power pins 301, 303, and 305 are neutral legs of heater circuits between adjacent power pins 302, 304, and 306, respectively. More specifically, a heater circuit in ZONE 1 would be between power pins 301 and 302, with the resistive heating element (e.g., element 22 shown in FIG. 1) between these power pins. A heater circuit in ZONE 2 would be between power pins 303 and 304, with the resistive heating element between these two power pins.

Similarly, a heater circuit in ZONE 3 would be between power pins 305 and 306, with the resistive heating element between these two power pins. It should be understood that these heater circuits are merely exemplary and are constructed according to the teachings of a cartridge heater described above and with reference to FIG. 1. Any number and configurations of heater circuits with multiple heater cores 300 and zones may be employed while remaining within the scope of the present disclosure. The illustration of four (4) zones and a cartridge heater construction is merely exemplary and it should be understood that the dissimilar power pins and jumpers may be employed with other types of heaters and in a different number and/or configuration of zones while remaining within the scope of the present disclosure.

It should be noted that the disclosure is not limited to the embodiment described and illustrated as examples. A large variety of modifications have been described and more are part of the knowledge of the person skilled in the art. These and further modifications as well as any replacement by technical equivalents may be added to the description and figures, without leaving the scope of the protection of the disclosure and of the present patent.

What is claimed is:

1. A heater for use in fluid immersion heating comprising:

a plurality of resistive heating elements submerged in a fluid; and a plurality sets of power pins electrically connected to the plurality of resistive heating elements, each set of power pins comprising:

a first power pin made of a first conductive material; and a second power pin made of a second conductive material that is dissimilar from the first conductive material of the first power pin, the first power pin being electrically connected to the second power pin to form a thermocouple junction, and the second power pin being electrically connected to the corresponding resistive heating element, wherein the thermocouple junctions between the first power pins and the second power pins are disposed at different predetermined heights, at least two of the thermocouple junctions submerged in the fluid at different predetermined heights, at least one of the thermocouple junctions exposed to air, and wherein each of the thermocouple junctions are configured to measure a temperature of the corresponding set of power pins, and a controller configured to determine the fluid level is a height between two heights of two immediately adjacent thermocouple junctions by determining a largest temperature difference between two immediately adjacent thermocouple junctions, one of the two immediately adjacent thermocouple junctions being above the fluid level and the other one of the two immediately adjacent thermocouple junctions being below the fluid level.

2. The heater according to claim 1, further comprising a heating portion configured for immersion into the fluid, the heating portion comprising the plurality of resistive heating elements.

3. The heater according to claim 2, wherein the second power pins extend into the heating portion.

4. The heater according to claim 2, further comprising at least two non-heating portions contiguous with the heating portion, each of the non-heating portions defining a length and comprising the plurality sets of the power pins.

5. The heater according to claim 4, wherein the heating portion extends in a horizontal direction and the at least two non-heating portions extend in a vertical direction.

6. The heater according to claim 5, further comprising at least two termination portions contiguous with the non-heating portions.

7. The heater according to claim 6, wherein the plurality of first power pins exit the non-heating portions and extend into the termination portions for electrical connection to lead wires and the controller.

8. The heater according to claim 1, wherein the second power pin define a cross-sectional area that is larger than the corresponding resistive heating element.

9. The heater according to claim 1, wherein the resistive heating elements are made of a material different from that first and second conductive materials.

10. The heater according to claim 1, wherein the controller is configured to control power supply to the resistive heating elements and detection of the fluid level through the plurality sets of power pins.

11. The heater according to claim 1, wherein each of the resistive heating elements are made of a material that is different from the first and second conductive materials of the first and second power pins.

12. A heater for use in fluid immersion heating comprising:

a heating portion configured for immersion into a fluid, the heating portion comprising a plurality of resistive heating elements submerged in a fluid;

at least two non-heating portions contiguous with the heating portion, each non-heating portion defining a length and comprising a corresponding plurality of sets of power pins electrically connected to the plurality of heating elements, each set of power pins comprising:

a first power pin made of a first conductive material; and a second power pin made of a second conductive material that is dissimilar from the first conductive material of the first power pin, the first power pin being electrically connected to the second power pin within the non-heating portion to form a thermocouple junction, and the second power pin extending into the heating portion and being electrically connected to the corresponding resistive heating element, the second power pin defining a cross-sectional area that is larger than the corresponding resistive heating element; and at least two termination portions contiguous with the non-heating portions, wherein the plurality of first power pins exit the non-heating portions and extend into the termination portions for electrical connection to lead wires and a controller, wherein each of the resistive heating elements are made of a material that is different from the first and second conductive materials of the first and second power pins, and wherein each of the thermocouple junctions of the first power pin to the second power pin is disposed at a different predetermined location along the lengths of the non-heating portions, at least two of the thermocouple junctions submerged in the fluid at different predetermined locations, at least one of the thermocouple junctions exposed to air, and wherein each of the thermocouple junctions are configured to measure a temperature of the corresponding set of power pins, and the controller configured to determine the fluid level is a height between two locations of two immediately adjacent thermocouple junctions by determining a largest temperature difference between two immediately adjacent thermocouple junctions, one of the two immediately adjacent thermocouple junctions being above the fluid level and the other one of the two immediately adjacent thermocouple junctions being below the fluid level.

13. A heater for use in fluid immersion heating comprising:

a plurality of resistive heating elements submerged in a fluid; and a plurality of power pins connected to the plurality of resistive heating elements for supplying power to the plurality of resistive heating elements, wherein the plurality of power pins each include a first material portion and a second material portion to form a thermocouple junction therebetween, and wherein the thermocouple junctions of the plurality of power pins are disposed at different predetermined heights, at least two of the thermocouple junctions submerged in the fluid at different predetermined heights, at least one of the thermocouple junctions exposed to air, wherein each of the thermocouple junctions are configured to measure a temperature of the corresponding set of power pins, and a controller configured to determine the fluid level is a height between two heights of two immediately adjacent thermocouple junctions by determining a largest temperature difference between two immediately adjacent thermocouple junctions, one of the two immediately adjacent thermocouple junctions being above the fluid level and the other one of the two immediately adjacent thermocouple junctions being below the fluid level.

14. The heater according to claim 13, wherein the controller is configured to control power supply to the resistive heating elements through the plurality of power pins, detection of temperatures of the plurality of power pins, and detection of the fluid level based on the temperatures of the power pins.

15. The heater according to claim 13, wherein the resistive heating elements extend in a horizontal direction and the plurality of power pins extend in a vertical direction.

16. The heater according to claim 13, wherein the second power pin of each of the plurality of power pins is connected to a corresponding one of the resistive heating elements and has a cross-sectional area larger than the corresponding one of the resistive heating elements.

17. The heater according to claim 13, wherein the resistive heating elements are made of a material different from that of the first and second material portions of the plurality of power pins.

* * * * *